US006872234B2

(12) United States Patent
Shibata

(10) Patent No.: US 6,872,234 B2
(45) Date of Patent: Mar. 29, 2005

(54) CUTTING MEMBER

(75) Inventor: Daisuke Shibata, Sendai (JP)

(73) Assignee: Kyocera Corporation, Kyoto (JP)

( * ) Notice: Subject to any disclaimer, the term of this patent is extended or adjusted under 35 U.S.C. 154(b) by 352 days.

(21) Appl. No.: 09/734,275

(22) Filed: Dec. 11, 2000

(65) Prior Publication Data

US 2001/0006594 A1 Jul. 5, 2001

(30) Foreign Application Priority Data

Dec. 24, 1999 (JP) ..... 11-366486

(51) Int. Cl.[7] ..... B22F 7/00; C22C 29/08

(52) U.S. Cl. ..... 75/245; 51/307; 51/309; 75/236; 75/241; 75/242

(58) Field of Search ..... 51/307, 309; 75/236, 75/241, 242, 245, 243, 244; 428/698, 699, 697, 325

(56) References Cited

U.S. PATENT DOCUMENTS 4,277,283 A * 7/1981 Tobioka et al.
4,279,651 A * 7/1981 Fujimori et al.
4,451,292 A * 5/1984 Hall et al.
RE34,180 E * 2/1993 Nemeth et al.
5,447,549 A * 9/1995 Yoshimura
5,580,666 A * 12/1996 Dubensky et al.
6,007,598 A * 12/1999 Dunmead et al.
6,207,262 B1 * 3/2001 Ichikawa et al.

FOREIGN PATENT DOCUMENTS

| | | | |
|---|---|---|---|
| EP | 214679 | * | 3/1987 |
| EP | 759480 | * | 2/1997 |
| JP | 05339659 | * | 12/1993 |
| JP | 10225804 | * | 8/1998 |
| JP | 10280947 | * | 10/1998 |
| JP | 11277304 | * | 10/1999 |

* cited by examiner

*Primary Examiner*—Archene Turner
(74) *Attorney, Agent, or Firm*—Hogan & Hartson LLP

(57) ABSTRACT

The cutting member comprises WC, two or more solid solutions of WC and compounds selected from carbides, nitrides and carbonitrides of metals of the groups 4a, 5a and 6a in the Periodic Table, and at least one metal of the iron group; and at least one of the two or more solid solutions being a solid solution having a high Nb or Zr content, whereby the wear resistance and plastic deformation resistance are improved in case of cutting hardly machinable materials such as stainless steel, thereby making it possible to prolong the service life of the cutting member.

4 Claims, 1 Drawing Sheet

CUTTING MEMBER

THE FIELD OF THE INVENTION

The present invention relates to a cutting member such as cutting tool, made of a high-strength and high-toughness tungsten carbide (WC) cemented carbide which has high wear resistance and high plastic deformation resistance and is particularly suited for cutting hardly machinable materials such as stainless steel which is hard to machine.

BACKGROUND OF THE INVENTION

As cemented carbides which have widely been used for cutting metals, there has hitherto been known a WC—Co alloy comprising a hard phase containing WC as a principal component and a bond phase made of a metal of the iron group such as cobalt, or an alloy obtained by adding carbides, nitrides or carbonitrides of metals of the groups 4a, 5a and 6a in the Periodic Table to the WC—Co alloy. In the latter case, grains of the solid solution of WC and carbides, nitrides and carbonitrides of metals of the groups 4a, 5a and 6a in the Periodic Table are added to the hard phase and bond phase.

These cemented carbides are principally utilized as a cutting tool for cutting cast irons and carbon steels, and are also utilized extensively for cutting stainless steels, recently. Stainless steels have been used in various fields because of characteristics such as excellent corrosion resistance, oxidation resistance and heat resistance, and the amount of them to be machined have been increased every year.

However, it has been known that stainless steels are typical hardly machinable materials because of properties such as easy occurrence of work hardening, low thermal conductivity and high affinity with tool materials.

Among WC cemented carbides for cutting tool, cemented carbides classified into so-called M series in accordance with JIS B 4053 (1996) are generally used to cut stainless steels. WC—TiC—Ta(Nb)C—Co cemented carbides are principally used in M series, and further TiC and Ta(Nb)C are added in a comparatively small amount to provide the cutting tool with the toughness.

However, even in case the stainless steel is cut by using a cutting tool made of a conventional cemented carbide of M series, it is hard to satisfactorily cut for a long time because of large wear amount of the cutting tool and short service life of the tool.

In addition, severe plastic deformation at the primary boundary portion is caused by a cutting resistance from the machined surface that is work-hardened during the cutting of the stainless steel, thus reducing service life of the tool.

SUMMARY OF THE INVENTION

A main object of the present invention is to provide a cutting member wherein the wear resistance and plastic deformation resistance are improved even in case of cutting hardly machinable materials such as stainless steel, thereby resulting in long service life of the tool.

Another object of the present invention is to provide a cutting member having improved chipping resistance.

The present inventors have intensively studied to attain the objects described above. As a result, they found a new fact that, in case a solid solution having a high Nb or Zr content is precipitated and dispersed in the structure of a WC cemented carbide, it is made possible to obtain a cutting member which has an excellent mechanical strength because of high hardness of the precipitate and also has excellent wear resistance and plastic deformation resistance even in case of cutting hardly machinable materials such as stainless steel.

In case of a conventional cutting tool, chipping that may be caused by the adhesion of the material to be cut to the tool surface occurs, thereby making the machined surface of the material to be cut worse. However, according to the present invention, it is made possible to strengthen the cemented carbide itself by precipitating and dispersing a solid solution having a high Nb or Zr content and to improve the chipping resistance, According to the present invention, there is provided a cutting member comprising WC, two or more solid solutions of WC and compounds selected from carbides, nitrides and carbonitrides of metals of the groups 4a, 5a and 6a in the Periodic Table, and at least one metal of the iron group; and at least one of two or more solid solutions being a solid solution having a high Nb or Zr content.

The other objects and advantages of the present invention will become apparent from the following detailed description.

DETAILED DESCRIPTION OF THE INVENTION

Figure 1:
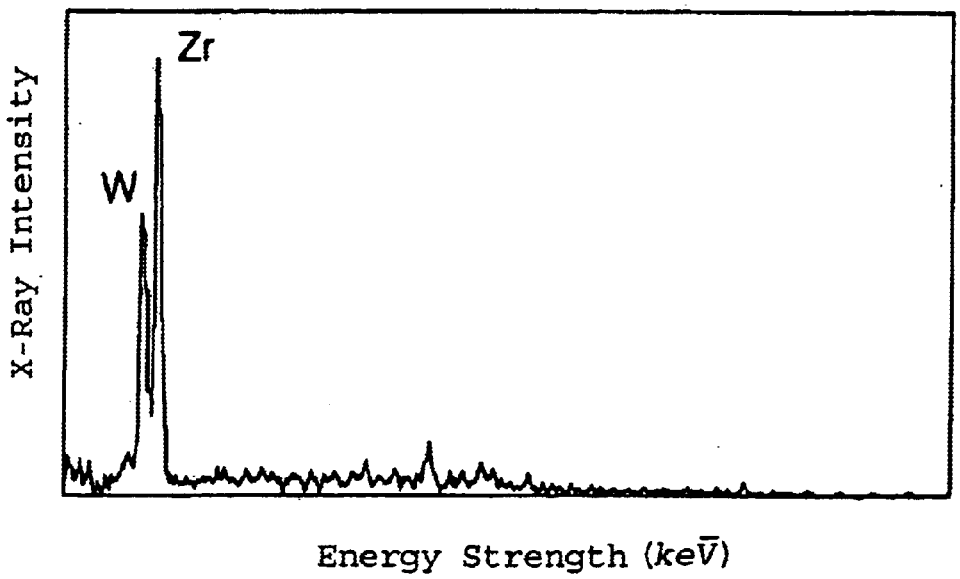
FIG. 1 is a graph showing X-ray spectroscopy of a solid solution having a high Zr content obtained in the sample No. 4.

One embodiment of the present invention will now be described. The cemented carbide constituting the cutting tool of the present invention is composed of a hard phase and a bond phase. The hard phase contains WC, and two or more solid solutions (complex carbide solid solution, complex nitride solid solution, or complex carbonitride solid solution) of said WC and carbides, nitrides or carbonitrides of metals of the groups 4a, 5a and 6a in the Periodic Table. The bond phase contains, as a principal component, a metal of the iron group such as Co and is preferably contained in the cemented carbide in the proportion within a range from 5 to 15% by weight. When the proportion of the bond phase is higher than the above range, the hardness and compressive strength are likely to be lowered, thereby to lower the wear resistance and to increase the wear amount of the tool. On the other hand, when the proportion of the bond phase is lower than the above range, chipping of the tool are likely to occur during the machining because the toughness is poor due to insufficient bond between hard phases.

Any of the above-described two or more solid solutions in the present invention preferably belongs to a B1 type (cubic system). In addition, at least one of the two or more solid solutions is a solid solution having a high Nb or Zr content.

The solid solution having a high Nb or Zr content is a solid solution having a peak intensity of Nb or Zr, which is 50% or more, preferably 50–120% of a peak intensity of W, in energy-dispersive X-ray spectroscopy. When the peak intensity of Nb or Zr is 50% or less of that of W, the content of W becomes relatively high. Therefore, the hardness of the alloy can not be enhanced, thereby making it impossible to exhibit high wear resistance and plastic deformation resistance.

An area ratio of the solid solution having a high Nb or Zr content to the whole solid solution structure is preferably 50% or less. When the area ratio of the solid solution to the whole solid solution structure exceeds 50%, the strength of the alloy is likely to be lowered because of excess precipitation of the solid solution having a high Nb or Zr content, thus increasing the plastic deformation and lowering chipping resistance of the tool. The area ratio must not be 0%. When the area ratio of the solid solution to the whole solid solution structure is 0%, the solid solution having a high Nb or Zr content is not precipitated, thereby to lower the wear resistance and to increase the wear amount of the tool.

The area ratio can be determined in the following manner. First, the cutting tool is cut at an arbitrary portion and the cross section thereof is ground and polished to obtain a mirror-like surface, and then this mirror-like surface portion is observed by an electron microscope (backscattered electron image). In the resulting photograph of the backscattered electron image, the solid solution having a high Nb or Zr content and the other solid solution differ in color because of a difference in atomic number and atomic weight of the elements constituting the composition of the solid solution. As a result, both solid solutions can be identified. Thus, it is made possible to determine the ratio of the area (area ratio) of the solid solution having a high Nb or Zr content to the whole solid solution structure by measuring the area of both solid solutions in an arbitrary region (20 $\mu$m×20 $\mu$m) using the image analysis method.

The term "solid solution other than the solid solution having a high Nb or Zr content" refers to a solid solution of the metal other than Nb and Zr, i.e. one or more metals of Ti, V, Cr, Mo, Hf and Ta, and WC and/or a solid solution of Nb or Zr in a low content, and WC. Regarding the solid solution which does not contain Nb or Zr or which contains Nb or Zr in a low content, the peak intensity of Nb or Zr is 50% or less, preferably 0–20% of the peak intensity of W, in energy-dispersive X-ray spectroscopy.

In the present invention, the two or more solid solutions are preferably contained in the cemented carbide in the proportion within a range from 0.5 to 10% by volume. When the content of the whole solid solution exceeds the above range, the mechanical strength of the cutting tool is lowered because the solid solution has intrinsically brittleness, thereby increasing the plastic deformation and lowering chipping resistance of the tool. On the other hand, when the content of the whole solid solution is lower than the above range, a cemented carbide classified into so-called K series is obtained and the characteristics at high temperature of the resulting cutting tool are lowered, thereby making it hard to machine hardly machinable materials. More preferably, the two or more solid solutions may be contained in the cemented carbide in the proportion within a range from 2 to 6% by volume.

An average grain size of the solid solution phase is preferably 5 $\mu$m or less, and more preferably 3 $\mu$m or less. Also, the average grain size of the solid solution having a high Nb or Zr content is preferably 5 $\mu$m or less, and more preferably 3 $\mu$m or less. When the average grain size of the solid solution phase exceeds 5 $\mu$m, the strength of the whole alloy is likely to be lowered because the wettability of the precipitated solid solution with the bond phase becomes inferior. The average grain size of the solid solution having a high Nb or Zr content may be more preferably 2 $\mu$m or less.

The average grain size of WC grains constituting the hard phase may be preferably within a range from 0.5 to 5 $\mu$m, and more preferably from 0. 5 to 2 $\mu$m.

A coating layer may be formed on the surface of the cutting member of the present invention. The coating layer is a single- or multi-layer made of at least one selected from MC, MN, MCN, TiAlN, $ZrO_2$ and $Al_2O_3$, provided that "M" denotes metal of the groups 4a, 5a or 6a in the Periodic Table, and MC, MN and MCN denote carbide, nitride and carbonitride of metal mentioned above, respectively, such as TiC, TiN or TiCN. The coating layer is preferably formed in a thickness within a range from about 0.1 to 20 $\mu$m by the CVD process, PVD process or the like.

The cutting member of the present invention is produced by weighing WC powder, one or more powders of carbides, nitrides and carbonitrides of metals of the groups 4a, 5a and 6a in the Periodic Table, and powder of a metal of the iron group such as Co as raw powders, mixing and pulverizing the powders, forming the mixed powders into a green body having a desired shape using a conventional known forming method such as pressing, and firing the resulting green body. The firing is conducted at a temperature within a range from 1623 to 1773 K under a pressure within a range from $10^{-1}$ to $10^{-3}$ Torr for 10 minutes to 2 hours. The cemented carbide thus formed is optionally provided with a coating layer on the surface. The coating layer is formed after washing the cemented carbide.

Preferably, the amount of the WC powder is within a range from 70 to 95% by weight and the amount of the powders of metals of the groups 4a, 5a and 6a in the Periodic Table is within a range from 0.1 to 20% by weight and, furthermore, the amount of the powder of the metal of the iron group is within a range from 5 to 20% by weight. More preferably, the amount of the WC powder is within a range from 85 to 95% by weight and the amount of the powders of metals of the groups 4a, 5a and 6a in the Periodic Table is within a range from 0.5 to 5% by weight and, furthermore, the amount of the powder of the metal of the iron group is within a range from 5 to 10% by weight.

To precipitate the solid solution having a high Nb and/or Zr content, the amount of carbides, nitrides or carbonitrides of Nb and/or Zr contained in the compound of the metal of the groups 4a, 5a or 6a in the Periodic Table maybe controlled. Specifically, to obtain the desired area ratio, the amount of the Nb compound and/or Zr compound is controlled so that the proportion (% by weight) of the compound of the metal of the groups 4a, 5a or 6a in the Periodic Table is almost the same as the desired area ratio.

As described above, the cutting member of the present invention has improved wear resistance and plastic deformation resistance to hardly machinable materials such as stainless steel and is also superior in chipping resistance. Thus, it is made possible to improve the cutting performance and to prolong service life of the cutting member.

EXAMPLES

The cutting member of the present invention will now be described in detail by way of examples.

Example

The respective inorganic powders as raw powders shown in Table 1 were weighed in the proportion shown in the same table and, after mixing and pulverizing the powders, the mixed powders were formed into a green body having a desired shape of a cutting tool (CNMG432) by pressing and the green body was fired at 1773 K under reduced pressure of 10 Torr or less for one hour.

The resulting sintered body was cut at an arbitrary portion and the cross section thereof is ground and polished to obtain a mirror-like surface, and then a backscattered electron image was observed by an electron microscope. Then, the ratio of the area (area ratio) of the solid solution having a high Nb and/or Zr content to the whole solid solution structure was determined from the photograph of the backscattered electron image on the basis of difference in color between the solid solution having a high Nb and/or Zr content and the other solid solution in arbitrary region (20 μm×20 μm) using the image analysis method.

Using a X-ray microanalizer (energy-dispersive analysis of X-ray, PV9800 manufactured by EDAX CO.), X-ray spectroscopy was conducted. A peak intensity of Nb or Zr in the solid solution having a high Nb and/or Zr content and a peak intensity of W were measured, thereby to determine a peak intensity ratio (%) according to the following formula.

Peak intensity ratio (%)=(peak intensity of Nb or Zr)×100/(peak intensity of W).

Figure 2:
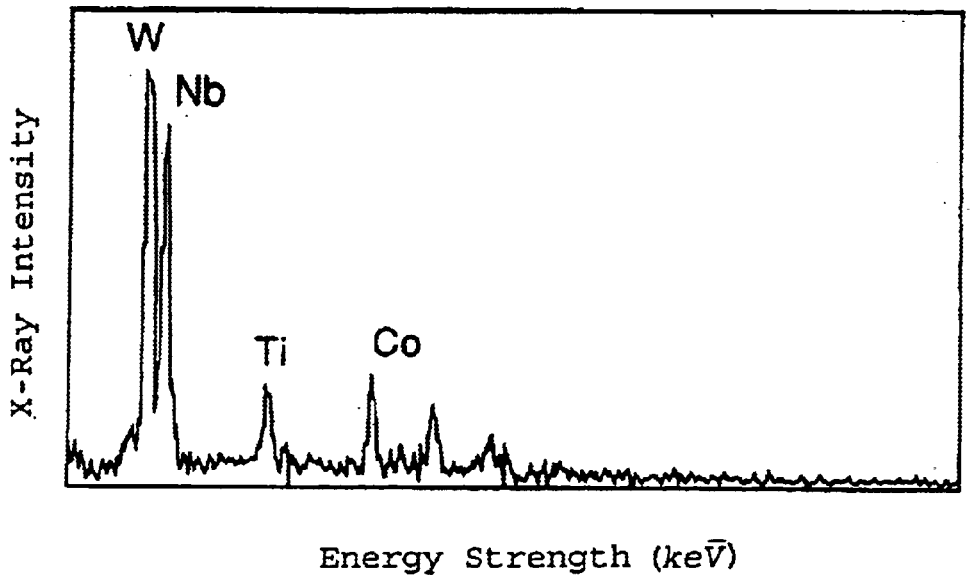
FIG. 2 is a graph showing X-ray spectroscopy of a solid solution having a high Nb content obtained in the sample No. 7.

A graph of X-ray spectroscopy of a solid solution having a high Zr content obtained in the sample No. 4 is shown in FIG. 1. A graph of X-ray spectroscopy of a solid solution having a high Nb content obtained in the sample No. 7 is shown in FIG. 2.

The measurement results are also shown in Table 1.

TABLE 1

| Sample | Composition (% by weight) | | | | | | Proportion of Nb, Zr compounds | Area ratio | Peak intensity ratio | Average grain size of solid solution |
|---|---|---|---|---|---|---|---|---|---|---|
| No. | WC | Co | TiC | TaC | NbC | ZrC | (% by mole) | (%) | (%) | (μm) |
| 1 | 88 | 9.4 | 2.6% in total amount | | | | 0 | 0 | 0 | 0.6 |
| ※2 | 88 | 9.4 | 2.6% in total amount | | | | 20 | 15 | 60 | 0.8 |
| ※3 | 88 | 9.4 | 2.6% in total amount | | | | 45 | 45 | 120 | 0.8 |
| ※4 | 88 | 9.4 | 2.6% in total amount | | | | 60 | 70 | 160 | 1.2 |
| 5 | 91 | 6.4 | 2.6% in total amount | | | | 5 | 0 | 5 | 0.5 |
| ※6 | 91 | 6.4 | 2.6% in total amount | | | | 20 | 10 | 50 | 0.7 |
| ※7 | 91 | 6.4 | 2.6% in total amount | | | | 40 | 50 | 85 | 0.8 |

The symbol ※ denotes a sample within the scope of the present invention.
The proportion of Nb, Zr compounds denotes the proportion of a Nb compound or a Zr compound in a β phase component, excluding WC and Co.

The surface of the resulting each sintered body was coated with a titanium carbonitride film having a thickness of about 5 μm by the CVD process to obtain a cutting tool made of a coated cemented carbide.

Test Example

Using the resulting cutting tool, a stainless steel was cut. Then, a cutting time required for an amount of any of flank wear (caused by direct friction of a material to be machined on flank face of a tool) and nose wear (occurred at a nose angle portion of a tool) to reach a value to be judged as service life of the tool (i.e. average flank wear amount: 0.2 mm, average nose wear amount: 0.2 mm) was measured. However, when the cutting time reached eight minutes before the wear amount does not reach the value corresponding to service life of the tool, the wear amount after cutting for eight minutes was measured.

The cutting conditions are as follows. During the cutting, a water-soluble cutting solution was used.

Material to be cut: stainless steel (SUS304)

Shape of tool: CNMG120408

Cutting rate: 200 m/minute

Feed rate: 0.3 mm/rev

Depth of cut: 2 mm

To evaluate the chipping resistance of each cutting tool, the high-temperature deflective strength test was conducted. The test was conducted under the same conditions as those described above, except that the thickness of the test piece was changed to 2.5 mm and the span of three-point bending was changed to 10 mm in accordance with JIS R 1601 using a Tensilon universal testing machine UCT30T manufactured by Orientec Co., a high-temperature deflective strength was determined. It is evaluated that the chipping resistance is good when the high-temperature deflective strength is 900 MPa or more.

These test results are shown in Table 2. In Table 2, the symbol X denotes "failure", the symbol ○ denotes "good" and the symbol ◎ denotes "excellent" in the respective evaluations.

TABLE 2

| | Flank wear (8 min.) | | Nose wear (8 min.) | | High-temperature deflective strength test | |
|---|---|---|---|---|---|---|
| Sample No. | Evaluation | Wear amount (mm) | Evaluation | Wear amount (mm) | Evaluation | Strength (MPa) |
| 1 | ○ | 0.19 | X | 7 min. * | X | 760 |
| ※2 | ◎ | 0.11 | ◎ | 0.15 | ○ | 950 |
| ※3 | ◎ | 0.10 | ◎ | 0.13 | ◎ | 1100 |
| ※4 | ○ | 0.16 | ○ | 0.19 | ◎ | 1050 |
| 5 | ○ | 0.16 | ○ | 0.19 | X | 830 |
| ※6 | ◎ | 0.09 | ◎ | 0.12 | ◎ | 1040 |
| ※7 | ◎ | 0.06 | ◎ | 0.10 | ◎ | 1150 |

The symbol ※ denotes a sample within the scope of present invention.
The symbol * denotes the time required for the wear amount to reach 0.2 mm.

As is apparent from the results of the wear test shown in Table 2, the sample No. 1 was inferior in wear resistance and the nose wear amount reached the value corresponding to service life within a short time because the solid solution having a high Nb or Zr content was not precipitated.

To the contrary, the samples Nos. 2, 3, 4, 6 and 7 containing the solid solution having a high Nb or Zr content, particularly the samples Nos. 2, 3, 6 and 7, exhibited excellent wear resistance and plastic deformation resistance during the cutting of stainless steel.

As is apparent from the results of the high-temperature deflective strength test shown in Table 2, the samples Nos. 2, 3, 4, 6 and 7 according to the present invention had a high high-temperature deflective strength.

What is claimed is:

1. A cutting member comprising:

WC having precipitated therein two or more solid solutions of WC and compounds selected from the group consisting of carbides, nitrides and carbonitrides of metals of group 4a, 5a, and 6a in the Periodic Table; and at least one metal of the iron group, wherein at least one of the two or more solid solutions is a solid solution having high Nb or Zr content.

2. The cutting member according to claim 1, wherein the solid solution having a high Nb or Zr content is a solid solution having a peak intensity of Nb or Zr, which is more than 50% of a peak intensity of W, in energy-dispersive X-ray spectroscopy.

3. The cutting member according to claim 1, wherein an area ratio of the solid solution having a high Nb or Zr content to the whole solid solution structure is 50% or less.

4. The cutting member according to claim 1, wherein the two or more solid solutions have an average grain size of 5 $\mu$m or less.

* * * * *